US009865238B2

(12) United States Patent
Demin

(10) Patent No.: US 9,865,238 B2
(45) Date of Patent: Jan. 9, 2018

(54) METHOD FOR MOUNTING A SOLENOID ABOVE A STRING OF STRINGED INSTRUMENT

(71) Applicant: Vladimir A. Demin, Moscow (RU)

(72) Inventor: Vladimir A. Demin, Moscow (RU)

( * ) Notice: Subject to any disclaimer, the term of this patent is extended or adjusted under 35 U.S.C. 154(b) by 0 days.

(21) Appl. No.: 15/491,838

(22) Filed: Apr. 19, 2017

(65) Prior Publication Data

US 2017/0221461 A1 Aug. 3, 2017

Related U.S. Application Data

(63) Continuation of application No. PCT/RU2015/000680, filed on Oct. 15, 2015.

(30) Foreign Application Priority Data

Oct. 20, 2014 (RU) ..... 2014142105

(51) Int. Cl.
*G10F 1/20* (2006.01)
*G10F 5/00* (2006.01)

(52) U.S. Cl.
CPC . *G10F 1/20* (2013.01); *G10F 5/00* (2013.01)

(58) Field of Classification Search
CPC ..... G10F 1/20
See application file for complete search history.

(56) References Cited

U.S. PATENT DOCUMENTS 948,474 A * 2/1910 Cartmell ..... G10F 1/20 84/8
1,871,021 A * 8/1932 Zachrison ..... G10F 1/20 84/320

(Continued)

FOREIGN PATENT DOCUMENTS

JP 2009031494 A 2/2009
JP 2010266823 A 11/2010

(Continued)

OTHER PUBLICATIONS

International Search Report from International Application No. PCT/RU2015/000880, filed Oct. 15, 2015, dated Mar. 31, 2016.

*Primary Examiner* — Robert W Horn
(74) *Attorney, Agent, or Firm* — Patentbar International, P.C.

(57) ABSTRACT

This invention relates to musical instruments. Its use for mounting a solenoid above a string of stringed instrument for pressing this string to a specific fret of finger-board allows to simplify that mounting and ensure the absence of the knock at a moment of actuating the solenoid. The method is implemented in a stringed instrument bearing, above a finger-board thereof, a common plate having through-holes under each solenoid comprising a coil, within which coil a plunger adapted for axial movement being disposed, the plunger tapering to an output stud thereof for limiting a working travel of the plunger with a stopper ring displaced at a coil edge facing the string, the output stud having thickening at an end with elastic washers at both the side facing the string and reverse side. The method includes steps of: securing the solenoid at a separate plate; disposing the separate plate above the common plate so that the thickening of the output stud permeates the respective through-hole; fixing the separate plate above the common plate, using adjusting screws with elastic spacers put thereupon between the separate plate and common plate, until the string being pressed with the stud on supplying a working current to the solenoid coil; shifting the separate plate using the adjusting screws in such a location that the pressure of the string occurs, on supplying the working current to the solenoid coil, without a knock arisen from an impact made by the plunger taper with the stopper ring.

6 Claims, 2 Drawing Sheets

(56) References Cited

U.S. PATENT DOCUMENTS

| | | | | |
|---|---|---|---|---|
| 6,723,904 | B1 | 4/2004 | Dolan et al. | |
| 7,285,716 | B2 * | 10/2007 | Gilmore | G10F 1/20 84/727 |
| 2013/0220099 | A1 | 8/2013 | Lyles et al. | |
| 2017/0221461 | A1 * | 8/2017 | Demin | G10D 3/163 |

FOREIGN PATENT DOCUMENTS

| | | | |
|---|---|---|---|
| KZ | 19335 | A | 4/2008 |
| RU | 2407067 | C1 | 12/2010 |

* cited by examiner

METHOD FOR MOUNTING A SOLENOID ABOVE A STRING OF STRINGED INSTRUMENT

RELATED APPLICATIONS

This application is a Continuation application of International Application PCT/RU2015/000680, filed on Oct. 15, 2015, which in turn claims priority to Russian Patent Applications No. RU 2014142105, filed Oct. 20, 2014, both of which are incorporated herein by reference in their entirety.

FIELD OF THE INVENTION

This invention relates to musical instruments, and particularly to a method for mounting a solenoid above a string of stringed instrument for pressing this string to a specific fret of finger-board.

BACKGROUND OF THE INVENTION

When creating devices which allow to reproduce musical pieces on stringed instruments without human input, a problem arises for pressing strings to respective frets.

One possible solution described in the U.S. Pat. No. 6,723,904 (publ. on Apr. 20, 2004) proposes a controlled moving carriage which disposing above a certain fret on the finger-board ensures a simultaneous press of all strings of the instrument to that fret, including the string which would sound. Such a solution has, besides its complexity due to the necessity for moving quickly the pressing carriage, a very limited use, since, when using that device, it is possible to play only those chords in which all strings are pressed to the same fret.

Solution for this problem are known where the strings' press is performed using solenoids mounted above or under the strings (see, for example, the Japan Patent Applications 2009-031494, publ. on Feb. 12, 2009, and 2010-266832, publ. on Nov. 25, 2010). In all those and other similar solutions, the solenoids ensure a stop of strings by means of intermediate mechanisms which are complex enough and require special means for excluding a knock arisen at a moment of actuating the solenoid.

SUMMARY OF THE INVENTION

Thus, a necessity exists in such a method for mounting a solenoid above a string of stringed instrument, which would be simpler than the known analogs and could ensure the absence of the knock at a moment of actuating the solenoid.

In order for solving that problem and achieving the indicated common result, the present invention provides a method for mounting a solenoid above a string of stringed instrument, which stringed instrument bearing, above a finger-board thereof, a common plate having through-holes under each solenoid comprising a coil, within which coil a plunger adapted for axial movement being disposed, the plunger tapering to an output stud thereof for limiting a working travel of the plunger with a stopper ring displaced at a coil edge facing the string, the output stud having thickening at an end with elastic washers at both the side facing the string and reverse side, the method including steps of: securing the solenoid at a separate plate; disposing the separate plate above the common plate so that the thickening of the output stud permeates the respective through-hole; fixing the separate plate above the common plate, using adjusting screws with elastic spacers put thereupon between the separate plate and common plate, until the string being pressed with the stud on supplying a working current to the solenoid coil; shifting the separate plate using the adjusting screws in such a location that the pressure of the string occurs, on supplying the working current to the solenoid coil, without a knock arisen from an impact made by the plunger taper with the stopper ring.

Herewith, the elastic washers and elastic spacers could be made from rubber.

BRIEF DESCRIPTION OF THE DRAWINGS

The present invention is explained using accompanying drawings, where the same numbers are assigned to the same elements.

DETAILED DESCRIPTION OF THE PREFERRED EMBODIMENTS

Pursuant to the present invention, in contrast with the known analogs, a solenoid is mounted above a string substantially orthogonally to the plane of stringed instrument finger-board. If this finger board has a convex form in the cross-section, the solenoid is mounted substantially orthogonally to the plane tangential to such finger-board along a line of pressure of that string.

Figure 1:
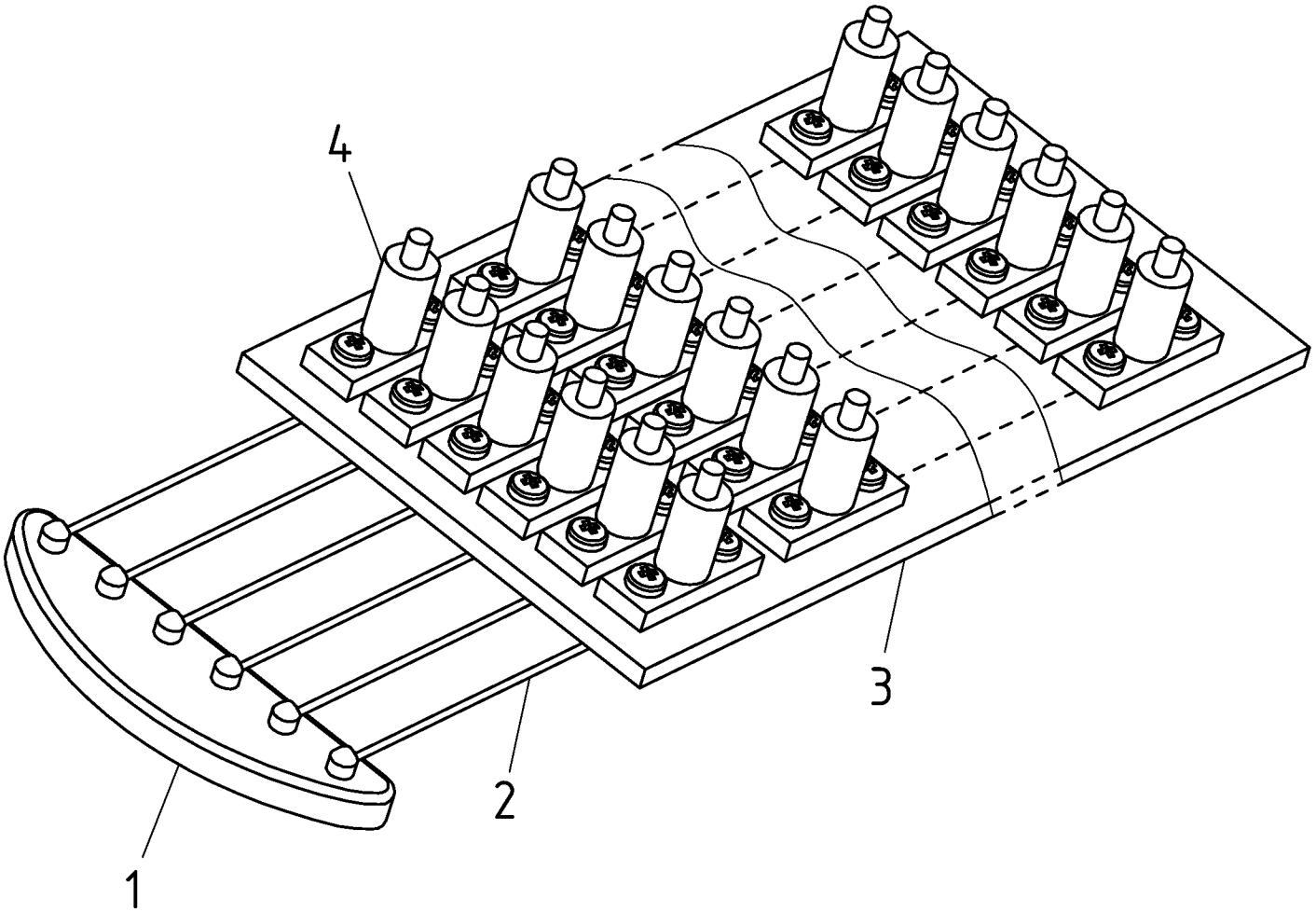
FIG. 1 shows a perspective view of a part of finger-board of stringed instrument with solenoids mounted in accordance with the present invention.

FIG. 1 shows a perspective view of a part of finger-board of stringed instrument with solenoids mounted in accordance with the present invention. In this example, the stringed instrument is a guitar, however this is only an illustration of possible embodiment of this invention and not a limitation of the scope thereof.

As shown in FIG. 1, a common plate 3 is mounted above a finger-board 1 with strings 2, and solenoids 4 are mounted on the common plate 3. The common plate 3 could be made from any material possessing a suitable durability. Each of the solenoids 4 is displaced above the respective string 2 in the location where this string 2 is pressed usually to a specific fret on the finger-board 1. Therefore, the solenoids 4 are lined above a respective fret. The common plate 3 has through-holes under each of the solenoids 4, the purpose of which through-holes will be explained further with reference to FIG. 2, where one solenoid is shown in cross-section in more details.

Figure 2:
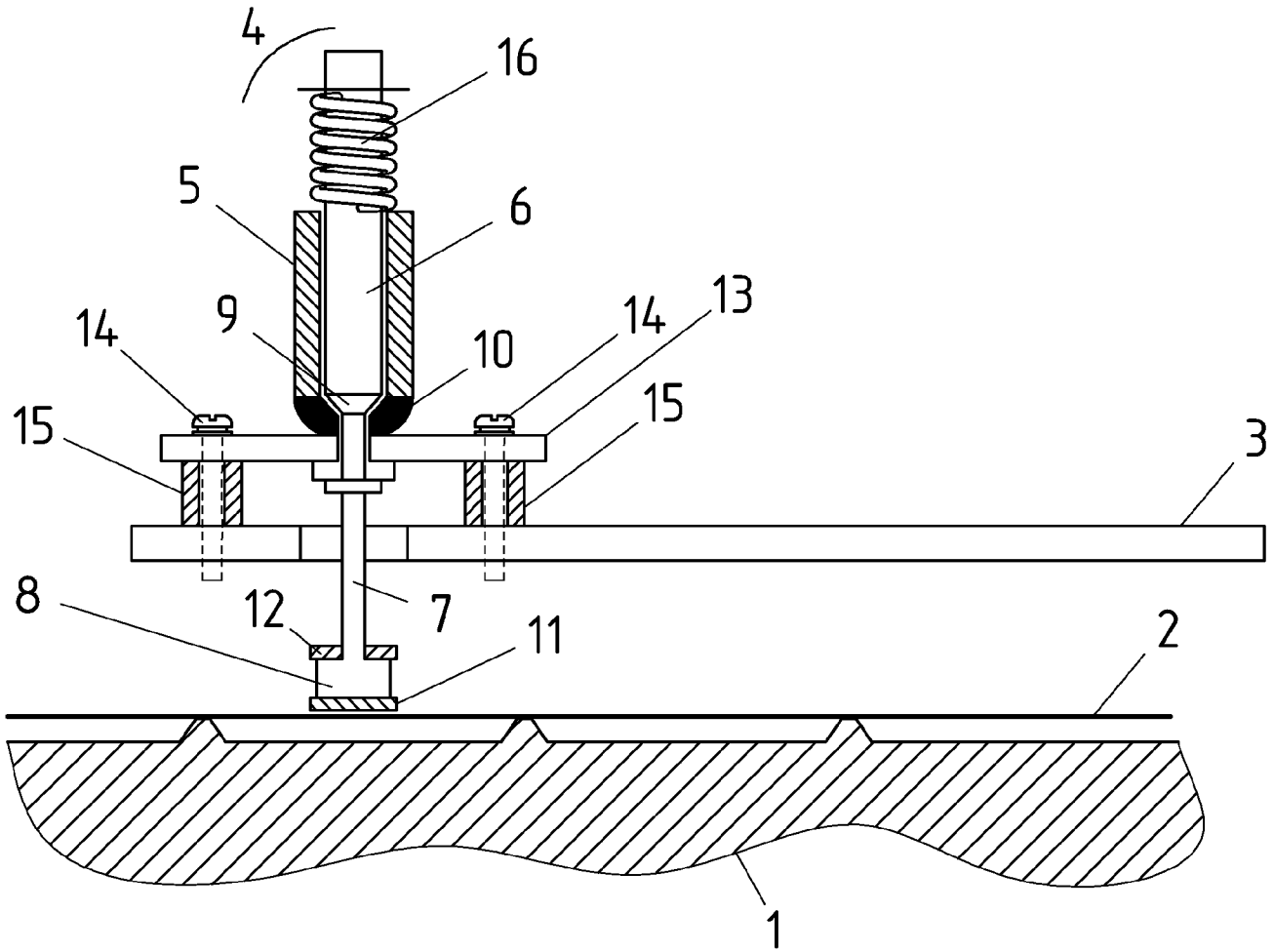
FIG. 2 shows in more details a cross-section of one solenoid, as well as some mounting elements.

As can be seen from FIG. 2, the solenoid 4 comprises a coil 5, within which coil a plunger 6 adapted for axial movement is disposed. The movement of the plunger 6 made from magnetic material within the coil 5 takes place on supplying the coil 5 with the working current. The plunger 6 has, at the working end thereof, an output stud 7 with a less diameter and terminate with a thickening 8 designed for pressing the string 2 to the finger-board 1. A taper 9 of the plunger 7 serves for interacting with a stopper ring 10 on the end of the coil 5 faced to the string 2 in order to limit a working travel of the plunger 6 on supplying the working current to the coil 5. A first elastic washer 11 is presented at the side of the thickening 8 faced to the string 2, and a second elastic washer 12 is presented at the reverse side of that thickening 8.

Each solenoid 4 is secured at a respective separate plate 13 by any known way, for example, with a nut screwed, at the reverse side of the separate plate 13, onto a threaded bush extending from the stopper ring 10. The separate plate 13 with the solenoid 4 secured thereon is disposed above the common plate 3 in such a manner that the thickening 8 at the end of the output stud 7 permeates the respective through-hole in the common plate 3, above which through-hole this solenoid 4 is disposed. The material of the separate plate 13 could be the same as of the common plate 3 or other material possessing a suitable durability. Preferably, both the common plate 3 and separate plate 13 are made from a metal, for example aluminum.

The separate plate 13 is fixed above the common plate 3 using adjusting screws 14 which are screwed with the threaded end into respective threaded holes in the common plate 3. Each of the adjusting screws 14 has an elastic washer 15 put thereon between the separate plate 13 and common plate 3. The separate plate 13 together with the solenoid 4 secured thereon is fixed until a respective string 2 is pressed with the thickening 8 of this solenoid 4 on supplying the working current to the coil 5 thereof. Herewith, at the moment of actuating the solenoid 4 (i.e., on supplying the working current to the coil 5 thereof), a knock could be heard due to the impact of the taper 9 situated between the plunger 5 and the output stud 7 with the stopper ring 10.

For that reason, the separate plate 13 is shifted using the adjusting screws 14 in such a location that the pressure of the string 2 to the finger-board 1 occurs, on supplying the working current to the coil 5 of the solenoid 4, without a knock arisen from an impact made by the taper 9 of the plunger 6 with the stopper ring 10. The first elastic washer 11 is designed for pressing the string 2 surely. The second elastic washer 12 eliminates the impact of the plunger 6 (thickening 8) on returning the plunger 6 after deactivating the solenoid 4. This return of the plunger 6 to the initial location is caused by a pullback spring 16 mounted between the reverse end of the coil 5 and a stop at the non-operational end of the plunger 6.

Those skilled in the art understand that the first and second elastic washers 11, 12 and the elastic spacers 15 could be made from any resilient material, e.g., from rubber of resilient plastic. Herewith, the first and second elastic washers 11, 12 are secured to respective sides of the thickening 8, for example, with glue.

Thus, the method for mounting a solenoid above a string of stringed instrument in accordance with the present invention is simpler than the known analogs and ensures the pressure of the string without a knock.

What is claimed is:

1. A method for mounting a solenoid above a string of a string instrument, the string instrument bearing a common plate above a finger-board of the instrument, the common plate having through-holes under each solenoid with a coil and a plunger inside the coil, the plunger being adapted for axial movement and tapering to an output stud of the plunger for limiting a working travel of the plunger with a stopper ring disposed at a coil edge facing the string, the output stud having a thickening at its end with elastic washers at both of sides of the thickening, one side facing the string and facing a back side, the method comprising:

securing the solenoid at a separate plate;

disposing the separate plate above the common plate so that the thickening of the output stud permeates its respective through-hole in the common plate;

fixing the separate plate above the common plate using adjusting screws with elastic spacers put thereupon between the separate plate and common plate until the string is pressed with the output stud when a working electrical current is supplied to the solenoid coil;

shifting the separate plate using the adjusting screws to such a location that the pressure on the string occurs without a knock from an impact made by the plunger on the stopper ring when the working current is supplied to the coil.

2. The method of claim 1, wherein the elastic washers and elastic spacers are made of rubber.

3. An apparatus for pressing strings to frets of a string instrument, the apparatus comprising:

a common plate mounted above a finger-board of the string instrument, the common plate having through-holes above a respective fret of each string;

solenoids, each of the solenoids comprising a coil and a plunger inside the coil, the plunger being adapted for axial movement and tapering to an output stud of the plunger, the output stud having its thickening end, the thickening serving to pressure the string to the finger-board;

each of the solenoids having a stopper ring serving to interact with the thickening of the plunger to limit a working travel of the plunger when a working electrical current is supplied to the coil;

each of the solenoids being secured at a separate plate disposed above the common plate in such a manner that the thickening at the end of the output stud permeates the respective through-hole in the common plate; and the separate plate being mounted using adjusting screws in such a location that the string is pressed to the respective fret without a knock from an impact made by the plunger taper on the stopper ring when the working current is supplied to the coil.

4. The apparatus of claim 3, wherein each solenoid further comprises a pullback spring disposed between a reverse end of the coil and a stop at a non-operational end of the plunger.

5. The apparatus of claim 3, wherein the thickening at the end of the plunger is provided with a first elastic washer at a side facing the string, and a second elastic washer is provided at a reverse side.

6. The apparatus of claim 4, wherein the thickening at the end of the plunger is provided with a first elastic washer at a side facing the string, and a second elastic washer is provided at a reverse side.

* * * * *